US009553387B2

(12) United States Patent
Tedeschi

(10) Patent No.: US 9,553,387 B2
(45) Date of Patent: Jan. 24, 2017

(54) ELECTRICAL CONNECTING DEVICE WITH SPRING CONNECTION ELEMENT AND COMPACT ACTUATOR AND MULTI-POLE PLUG CONNECTOR COMPRISING A PLURALITY OF SAID SPRING CONTACTS

(71) Applicant: INDUSTRIA LOMBARDA MATERIALE ELETTRICO-I.L.M.E. S.P.A., Milan (IT)

(72) Inventor: Tito Alessandro Tedeschi, Bollate (IT)

(73) Assignee: INDUSTRIA LOMBARDA MATERIALE ELETTRICO—I.L.M.E. S.P.A., Milan (IT)

( * ) Notice: Subject to any disclaimer, the term of this patent is extended or adjusted under 35 U.S.C. 154(b) by 0 days.

(21) Appl. No.: 14/790,306

(22) Filed: Jul. 2, 2015

(65) Prior Publication Data

US 2016/0020543 A1 Jan. 21, 2016

(30) Foreign Application Priority Data

Jul. 15, 2014 (IT) ..... MI2014A1287

(51) Int. Cl.
*H01R 13/42* (2006.01)
*H01R 4/48* (2006.01)

(52) U.S. Cl.
CPC ..... *H01R 13/42* (2013.01); *H01R 4/4827* (2013.01); *H01R 4/4836* (2013.01); *H01R 4/4845* (2013.01); *H01R 2201/20* (2013.01)

(58) Field of Classification Search
CPC ..... H01R 4/4836; H01R 4/4845; H01R 4/48; H01R 13/42; H01R 2201/20; H01R 4/4827
See application file for complete search history.

(56) References Cited

U.S. PATENT DOCUMENTS 6,750,402 B2 * 6/2004 Geske ..... H01R 4/4845 174/135
6,786,779 B2 * 9/2004 Feldmeier ..... H01R 13/506 439/729

(Continued)

FOREIGN PATENT DOCUMENTS

DE 2706482 A1 8/1978
DE 10145324 A1 4/2003

(Continued)

OTHER PUBLICATIONS

English Translation of Ramm, EP 1555723.*
Italian Search Report mailed Mar. 3, 2015, corresponding to Italian Patent Application MI20141287.

*Primary Examiner* — Amy Cohen Johnson
*Assistant Examiner* — Matthew T Dzierzynski
(74) *Attorney, Agent, or Firm* — Ladas & Parry LLP

(57) ABSTRACT

An electrical connecting device (10) comprising an electrical insulating body (20) with at least one pair of longitudinal parallel seats (23) and (24) adapted to house, respectively, a connecting element (30) with a spring terminal and an actuator pin (40) having a cam profile oriented towards a spring (32) of the terminal to cause the opening and closure of the terminal by sliding into the corresponding seat, said spring (32) being a ring-shaped spring having a curved lower portion (34), a back ascending portion in form of a leg (35) engageable with a projecting portion (41) of said cam profile of the actuator pin (40) and an upper portion (36) with a slot (37) adapted to receive at least one electric conductor (60), wherein said cam profile of the actuator pin (40) has at least a tapered side (45) and a remaining ribbed portion (46), and that said back ascending portion in form of a leg (35) of the spring (32) has a corresponding groove (39) apt to house said at least one ribbed portion (46) of the (Continued)

actuator pin (40) in the maximum extroversion status of the spring, that is when the terminal is closed and empty.

9 Claims, 11 Drawing Sheets

(56) References Cited

U.S. PATENT DOCUMENTS

| | | | | |
|---|---|---|---|---|
| 6,796,855 | B2 * | 9/2004 | Fricke | H01R 4/4818 439/835 |
| 7,083,463 | B2 * | 8/2006 | Steinkemper | H01R 4/4827 439/441 |
| 7,438,587 | B2 * | 10/2008 | Germani | H01R 4/4836 439/441 |
| 8,251,738 | B2 * | 8/2012 | Heckert | H01R 4/4836 439/441 |
| 8,328,588 | B2 * | 12/2012 | Ramm | H01R 4/4845 439/828 |
| 9,287,638 | B2 * | 3/2016 | Germani | H01R 4/48 |
| 2008/0083097 | A1 * | 4/2008 | Lang | H01R 4/4827 24/305 |
| 2014/0141657 | A1 | 5/2014 | Germani | |

FOREIGN PATENT DOCUMENTS

| | | | | |
|---|---|---|---|---|
| DE | EP 1555723 | * | 1/2005 | H01R 4/48 |
| DE | 102007009082 | A1 | 9/2007 | |
| EP | 1294053 | A2 | 3/2003 | |
| EP | 1555723 | A1 | 7/2005 | |

* cited by examiner

ELECTRICAL CONNECTING DEVICE WITH SPRING CONNECTION ELEMENT AND COMPACT ACTUATOR AND MULTI-POLE PLUG CONNECTOR COMPRISING A PLURALITY OF SAID SPRING CONTACTS

The present invention relates to an electrical connecting device with spring connection element, particularly an electrical connection terminal for the connection of one or more electrical conductors, equipped with a compact actuator. In particular, without excluding other embodiments of the invention, the electrical connecting element is in the form of an element of male (plug) or female (socket) electric contact.

In particular, the electrical connecting device in question may also be suitable to be housed in the insulating body of a multi-pole connecting device, such as an electrical plug connector, for the connection of an electrical conductor of a type either having a plurality of strands (flexible conductor) or of the single-wire type (rigid or flexible but prepared with a ferrule crimped termination).

STATE OF THE ART

Electrical connection elements and electrical connection terminals suitable for connecting one or more electrical conductors through the action of a tension spring are well known in the art.

Among the most common forms of tension spring for said elements there is the one described in DE 2706482 (Wago), in particular realized starting from a strip of resilient material shaped in the manner of a ring.

In DE 102007009082 (ILME) an evolution of such connecting devices with spring contacts is described which envisages the presence, for each terminal, of an actuator in the form of a sliding pin that operates the closing or opening of the tension spring and consequently the connection or the release of the conductor from the terminal without the use of a tool (e.g.: a screwdriver with flat tip for slotted end screws) for closing the connection terminal for making the electrical connection between the conductor and the contact, such tool becoming required only for possible subsequent reopening. This invention has made the cabling operation independent of the operator, i.e. from the level of training and skill of the operator.

In IT MI2012A001974 (ILME) not yet published at the priority date of the present application (now granted on 2015-03-26 as IT 1.414.636), a further evolution of the invention previously called up is described, in which the actuators of the spring connection elements are provided with a longitudinal groove adapted to allow, for example, the introduction of a metal probe to perform electrical measurements.

EP 1555723 discloses a screwless terminal comprising a contact part (3) with connection portion (31) to which a conductor (7) is electrically connected, an annular clamping spring (1) having a clamping leg (11), a latching (15) and a locking counterpart (16) to form a closed ring in the locking position, an actuating element for the clamping spring, and a metallic frame (2) which surrounds the clamping spring (1) and with this forms a structural unit.

PROBLEMS OF THE KNOWN ART

The devices for electrical connection with spring contacts and actuator of the known art, based on the typical ring shape of the spring referred to in the aforementioned DE 2706482, suffer from the inconvenient to determine a rather remarkable transverse dimension: the pin actuator, frontally shaped with a cam profile, to operate the opening and closing of the spring of the clamping unit, acting on the so-called "leg" of the spring, has by necessity, when the connecting element is in "open" position, a transverse dimension, at the rear of the spring itself, which determines a limitation of density of said spring connection elements with actuator, implementable on adjacent parallel rows, for example in compact multi-pole terminal blocks or in multi-pole electrical plug connectors.

For the corresponding slots in the insulating body of the multi-pole terminal block or of the multi-pole plug connector significant transverse dimensions are in fact requested, such as to prevent the adoption of such spring-loaded electrical connection elements with actuator in multi-pole devices with high contact density, in particular when e.g. the multi-pole plug connector were limited in its maximum size by the available internal size of the relevant protective housing.

An alternative embodiment of the actuator pin in the prior art devoid of transverse dimensions posteriorly to the spring and not by varying the shape of the latter compared to the classical one of the prior art, foresees a greater overall width of the actuator pin itself, which embraces the spring to the sides, but it entails for a connecting device equipped with such electric connection element with spring actuator, a greater overall width for the necessarily increased lateral dimension of the actuator pin. This makes it inconvenient to use such a connecting element in pre-existing multi-pole connecting devices, for the pitch increment that would be necessary between the connection elements placed side by side.

An alternative of spring connection element with actuator based on a different design of the spring, with a spring element of the sleeve type is described in DE 10145324 (EP 1294053) (Harting). This technique, although more compact, however, suffers from serious drawbacks: (1) it is still necessary a tool (e.g.: a screwdriver with flat tip for slotted end screws) for closing the clamp, due to the small dimensions of the actuator pin and (2) is only suitable for stranded flexible conductors, thus not for conductors prepared with crimped ferrules (a solution highly appreciated by the wiring harness makers for electrical distribution panels) or for unipolar wires, solid or stranded, the use of which is still widespread in many countries for the wiring of fixed electrical installations.

OBJECT OF THE INVENTION

The object of the present invention is therefore to eliminate the drawbacks of the above described prior art, in particular to provide an electrical connecting device with spring connection element as described in DE 2706482, provided with actuator as foreseen in DE 102007009082, which has a compact shape, so as to reduce the transverse dimensions of the device, and increase the density of the connection elements in case of use of the same in multi-pole plug connectors, while keeping all the advantages offered by the spring connection elements with ring-shaped spring. Another object of the invention is to provide such an electrical connecting device suitable for both flexible and rigid conductors and adapted to accommodate more than one conductor.

Another object of the invention is to provide an electrical connecting device of the above type, in which the actuator pin does not present a width greater than that of the spring connection element and corresponding terminal.

A further object of the invention is to provide such an electrical connecting device which is of simple and economical to produce.

DESCRIPTION OF THE INVENTION

The electrical connecting device according to the invention has the characteristics of the herewith enclosed independent claim 1.

Advantageous embodiments of the invention are set out in the dependent claims.

Basically, the electrical connecting device according to the invention, comprising a body housing the spring connection element and the actuator, presents a reshaping of the tension spring of the connection element, in particular in a limited portion of the so-called "leg" of the spring ring (also called "cage"), which acts as a lever arm for the closure of the part that operates as a true spring, constituted by a lower portion curved in a semicircle.

The actuator pin has a cam profile with at least one tapered side and a remaining ribbed part and the leg-like ascending rear portion of the spring has a corresponding groove adapted to house said at least one ribbed part of the actuator pin in a condition of maximum extension of the spring, that is with clamp closed and empty.

Thus it is usefully reduced, compared to the known art, the overall transverse dimensions of the actuator pin until zeroing it at the "clamp closed" position (position of maximum transverse bulk).

It is therefore possible to lodge such an electrical spring connection element with actuator for example in compact multi-pole terminals or in high density multi-pole plug connectors which foresee more rows of contacts adjacent and close together.

In particular, for use in multi-pole plug connectors, it is achievable to keep the maximum transverse bulk of the spring connection element with actuator equal to that required in similar multi-pole plug connectors with spring connection devices without actuator. The same coupling interface (thus the same contact density) of pre-existing multi-pole spring-clamp plug connectors deprived of actuator can therefore be kept in spring-clamp versions of said plug connectors with actuator pin.

BRIEF DESCRIPTION OF DRAWINGS

Further characteristics of the invention will be made clearer by the detailed description that follows, referring to a merely exemplary and therefore non limiting embodiment thereof, illustrated in the enclosed drawings, in which.

DETAILED DESCRIPTION OF A PREFERRED EMBODIMENT

Figure 1:
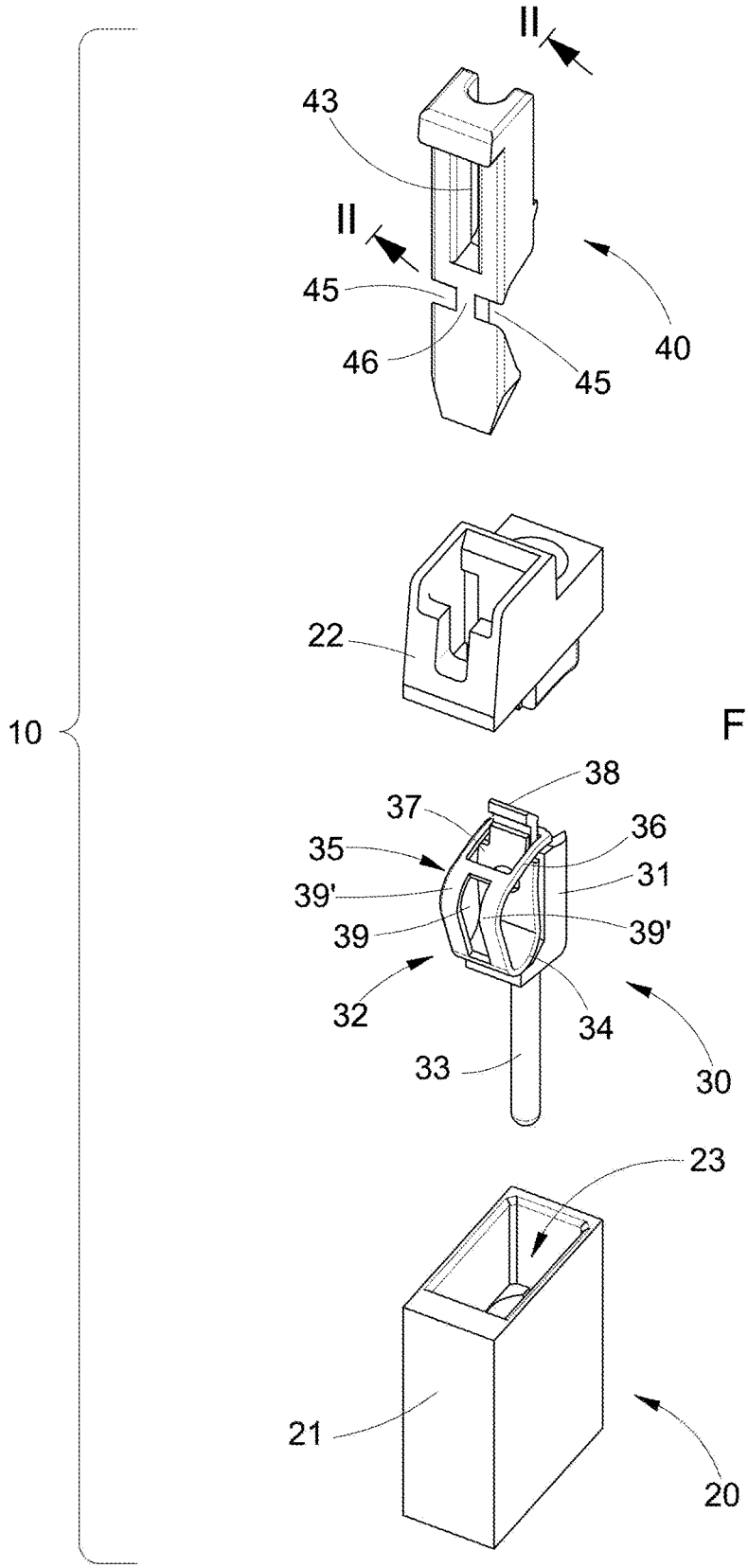
FIG. 1 is an axonometric exploded view of an electrical connecting device according to the invention.
Figure 2:
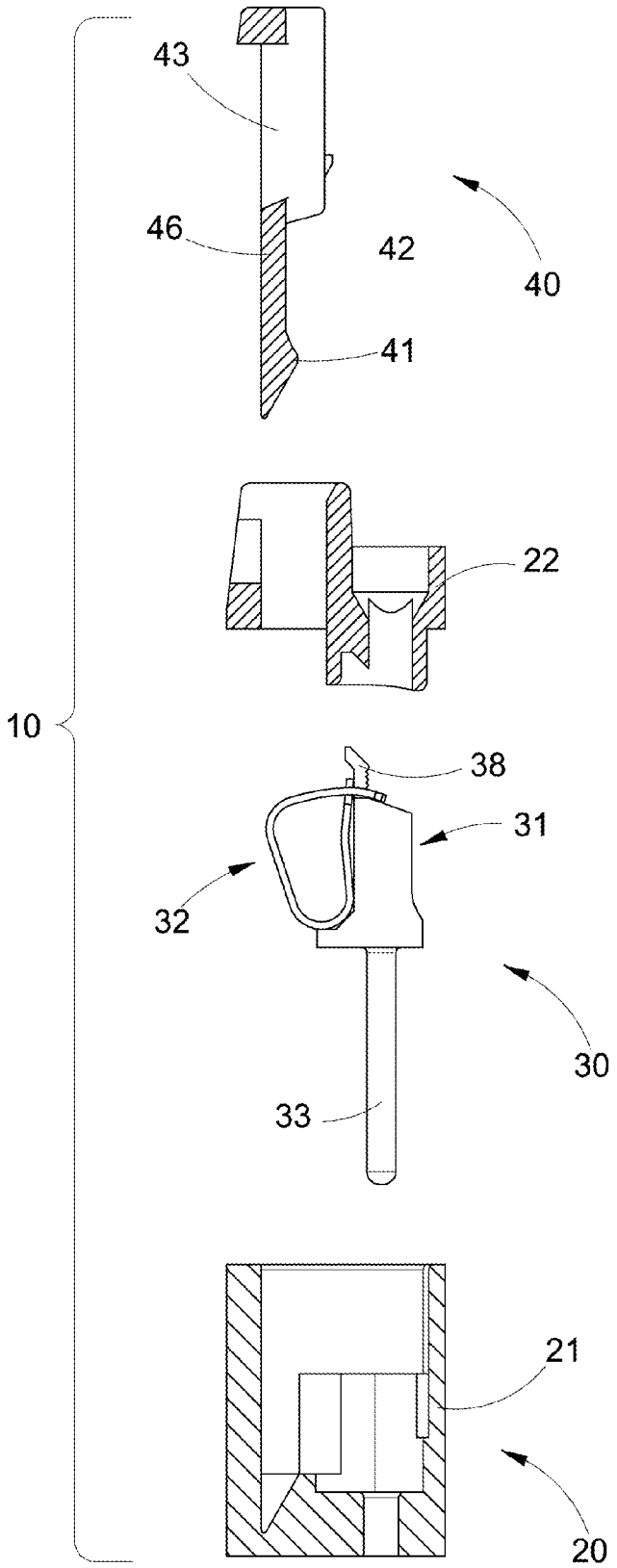
FIG. 2 is a cross-sectional view, taken along the plane II-II of the exploded view of FIG. 1.
Figure 3A:
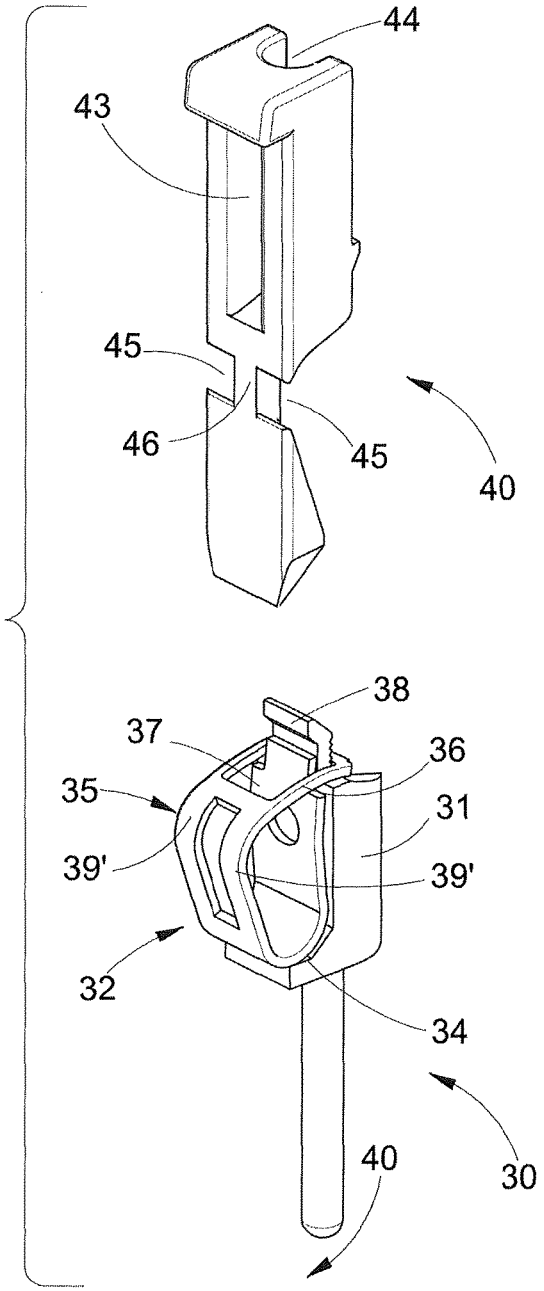
FIG. 3*a* is an isometric view showing in exploded view the spring-clamp element for electrical connection and the actuator pin of the connection device according to the invention.
Figure 3B:
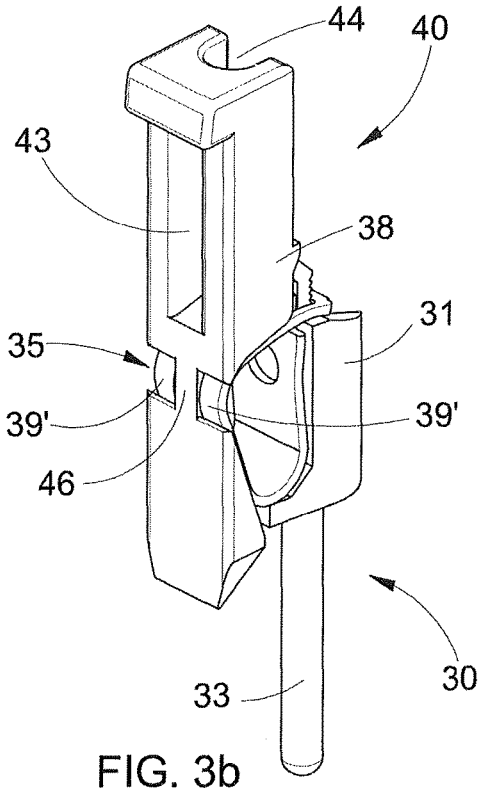
FIG. 3*b* shows the elements of FIG. 3*a* in assembled condition, in position of clamp closed, empty, without conductor.
Figure 3C:
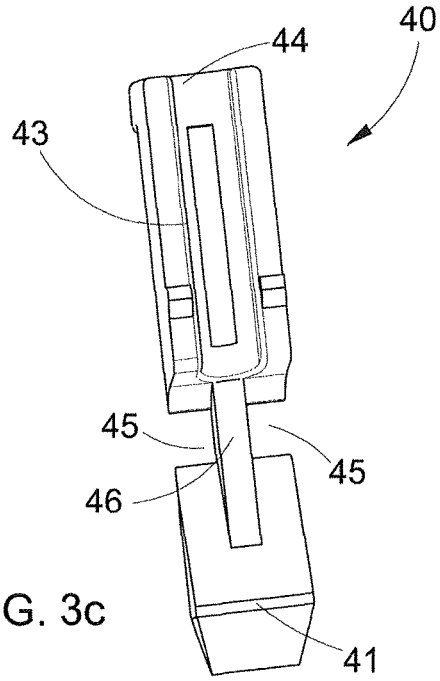
FIG. 3*c* is an isometric view of the actuator pin alone taken from the opposite side with respect to FIG. 3*a;*

In FIGS. 1 to 9 an exemplifying embodiment of an electric connection element according to the invention is shown, globally indicated by the reference number 10. It comprises an insulating body 20, constituted by a base 21 and a cover 22 that, once assembled (FIGS. 4-9) determine two longitudinal parallel seats, open upwards 23, 24 for the housing, respectively, of an electrical connection element 30 and of an actuator pin 40, conformed as described in the cited document DE 102007009082, with the changes that will be described.

The connection element 30 has a first terminal 31 with annular tension spring (also called "cage shaped") 32 fixed to said terminal 31 and, in the example described, an element of male electrical contact pin 33 projecting downward from the insulating body 20. Alternatively, the electric contact element 33 may be of the female socket type.

The tension spring 32, known per se, as described in DE 2706482, is a leaf spring that has precisely a closed loop conformation, with a curved lower portion, substantially in a semicircle 34 which acts as a real spring, a portion which is rear with respect to respect said terminal 31 (it is also continued with said curved elbow shaped lower portion 34 and is ascending from said curved lower portion 34), that will be called "leg" 35, and a top portion 36 with a slot or an aperture 37 which accommodates in a upper protrusion 38 of the connecting element 30 or of a portion of the spring opposite to the leg 35, to allow flexing of the spring as a result of an external stress, and therefore the opening and closing of the clamp.

The actuator pin 40 is of prismatic shape with vertical longitudinal extension and can slide in the respective seat 24 to actuate the spring 32 and open or close the clamp. In particular, the actuator pin 40 has at the bottom a cam shaped front profile with a projecting portion 41 adapted to interfere with said spring 32 to operate the opening and closing of the clamp, and a depression 42 adapted to house said leg 35 of the spring 32 in the condition of clamp closed and absence of conductor.

The actuator pin 40 also presents a top lateral seat 43 for a hand tool such as a screwdriver with flat tip for slotted end screws 50 (see in particular FIGS. 7 and 8) for the reopening of the clamp, substantially as described in the cited document DE 102007009082.

The actuator pin 40 also presents a longitudinal groove 44 facing in the direction of the spring 33, adapted to allow insertion of the probe of a test device for making electrical measurements, as described in the aforesaid patent application IT MI2012A001974 (granted on Mar. 3, 2015 as IT1414636).

Figure 4B:
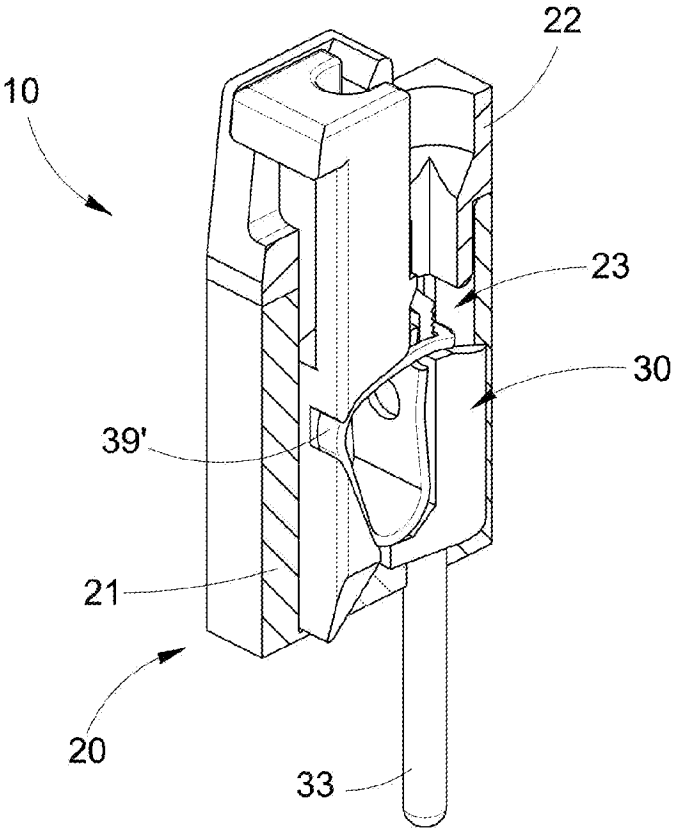
FIG. 4*b* is an axonometric view of the section of FIG. 4*a;*
Figure 4A:
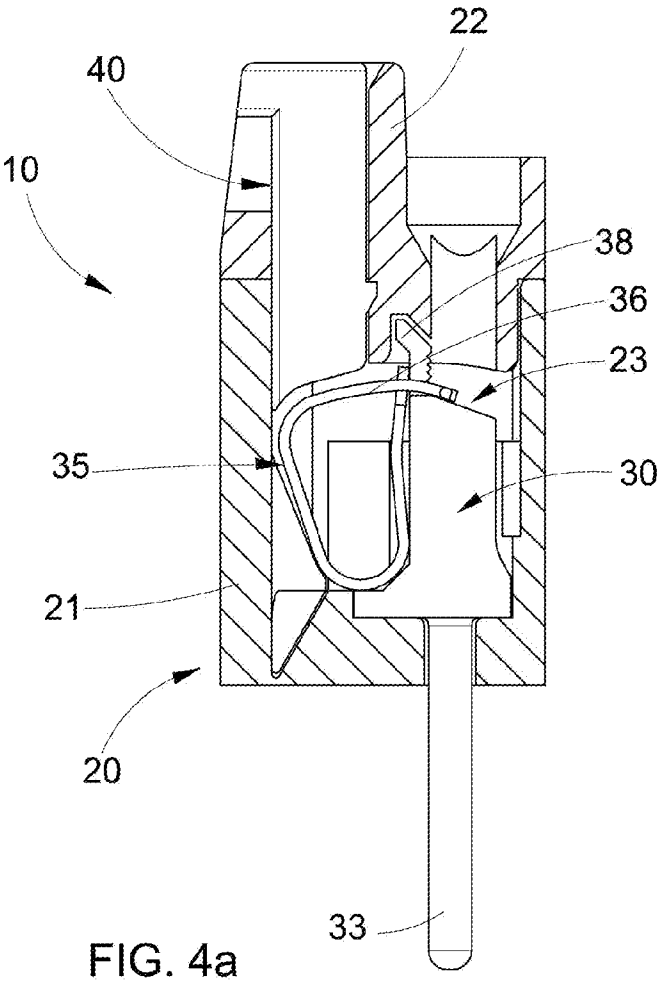
FIG. 4*a* is a cross-sectional view like that of FIG. 2, showing the electrical connecting device assembled, clamp closed, empty, without conductor, as in FIG. 3*b;*

The substantial differences of the connecting device according to the present invention with respect to the one described in the document DE 102007009082, which allow to reduce the inner transverse bulk of the device, and then to obtain an increase of the density of connection elements in case of multi-pole terminal blocks or plug connectors, consist in the fact that in correspondence of the said hollow 42 formed in the actuator pin 40 two tapers or indentations 45 of the flanks of the pin are provided, bounded by an intermediate ribbed part, preferably central, 46 (best seen in FIG. 3*c*), and said leg-like ascending portion 35 of the spring 32 has a corresponding window or groove 39, adapted to receive said ribbed portion 46 of the actuator in closed clamp conditions, at rest, without conductor, as shown in FIGS. 4*a* and 4*b*. In this rest condition, the housing of the ribbed part of the actuator 46 in the window 39 of the spring and the housing of the solid parts 39' delimiting the window 39 in the corresponding tapered sides 45 of the actuator allow the complete extension of the spring.

According to an alternative embodiment, only a tapered side 45 can be expected in the actuator and the remaining ribbed part 46, and a corresponding lateral groove 39 and the solid part 39' in the spring, that complement in the condition of closed clamp, at rest, without conductor, allowing the complete extension of the spring.

With reference to FIGS. 5 to 9 will now be briefly described the operation of the electrical connecting device according to the invention, which is completely identical to that described and illustrated in the cited document DE 102007009082.

Figure 5B:
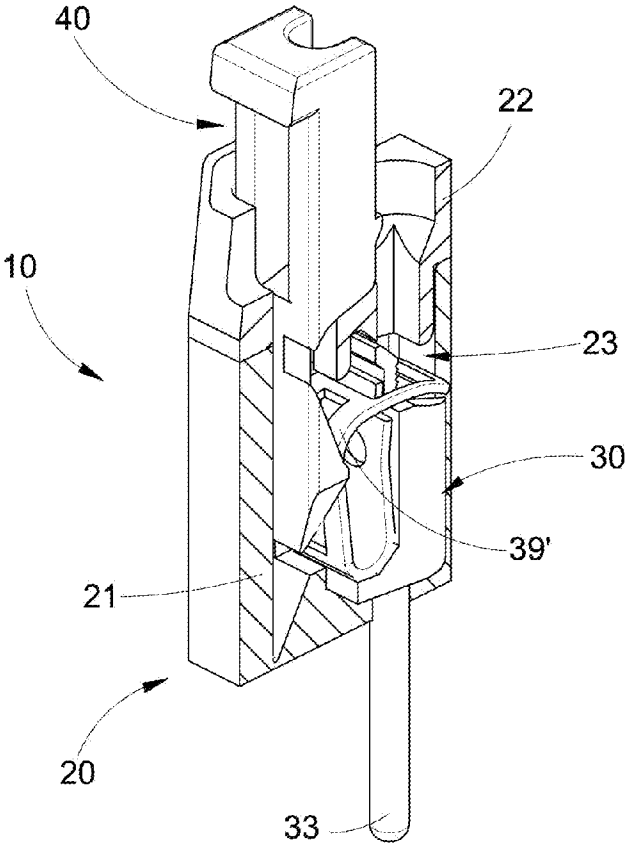
FIG. 5*b* is an axonometric view of the section of FIG. 5*a;*
Figure 5A:
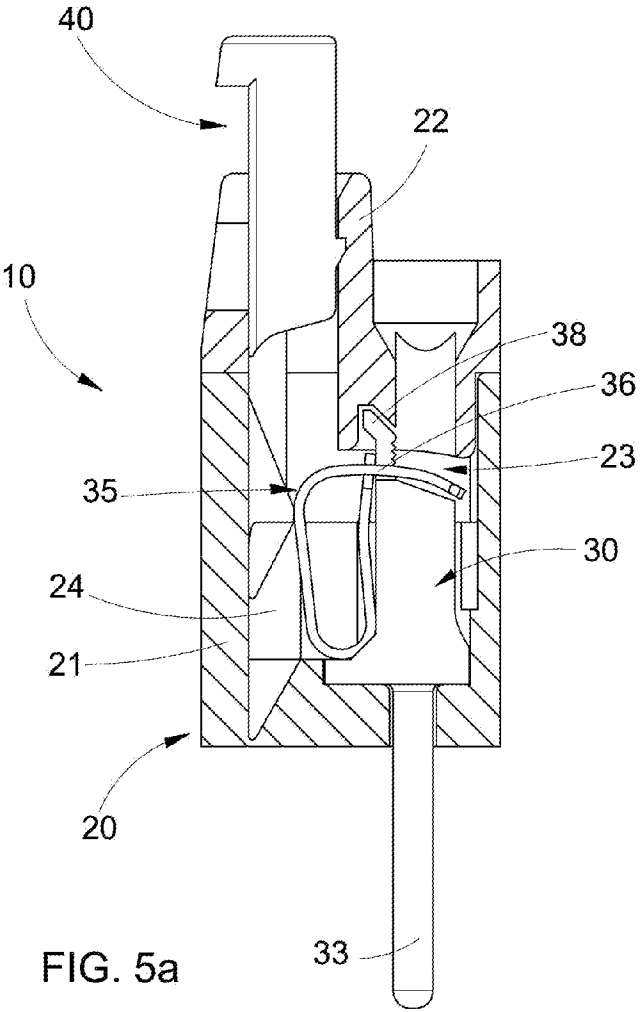
FIG. 5*a* is a cross-sectional view showing the electrical connecting device in the open clamp position with actuator pin fully extended.
Figure 6B:
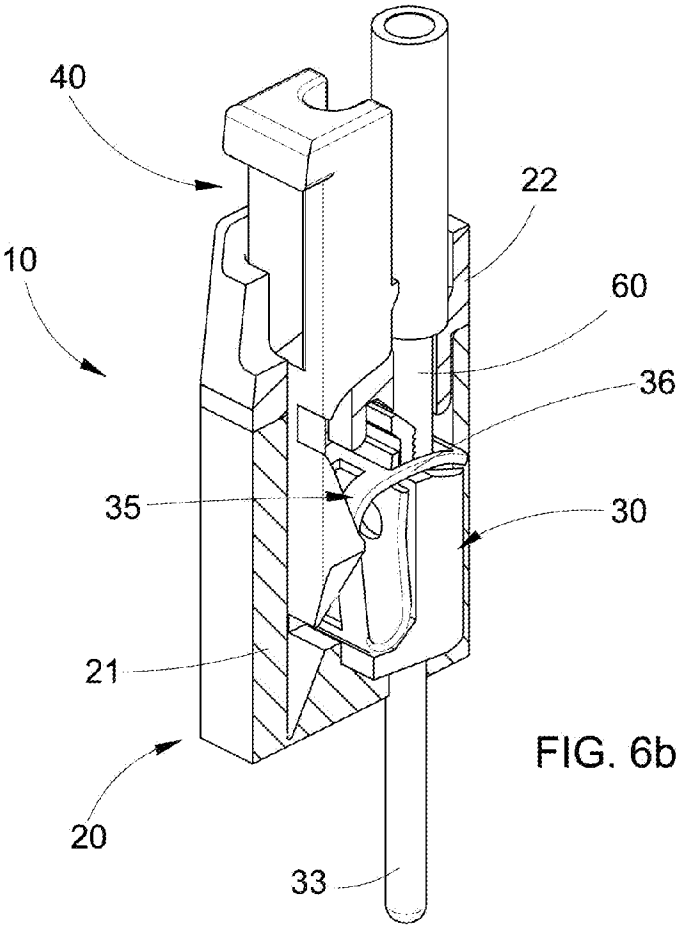
FIG. 6*b* is an axonometric view of the section of FIG. 6*a;*
Figure 6A:
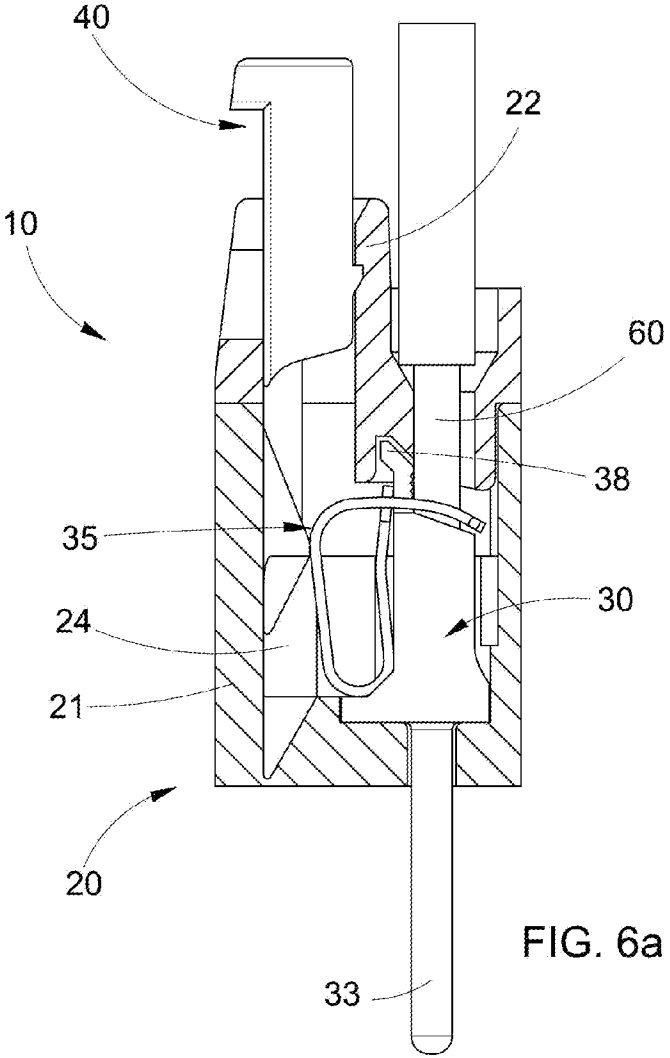
FIG. 6*a* is a cross-sectional view showing the electrical connecting device in the open clamp position with actuator pin fully extended and conductor inserted into the corresponding housing seat.

In FIG. 5 the device is in the condition of open clamp, without conductor, with actuator pin 40 completely extracted in its own housing seat 24 and the spring ring 32 compressed by the protrusion 41 of the cam profile of the actuator, so that the upper slot or aperture 37 of the spring is ready to receive an electrical conductor 60, as shown in FIG. 6. In FIG. 6 and following ones a rigid conductor 60 is shown, but it is evident that the electrical connection element 30 can as well accommodate either a flexible conductor or even multiple conductors.

Figure 7B:
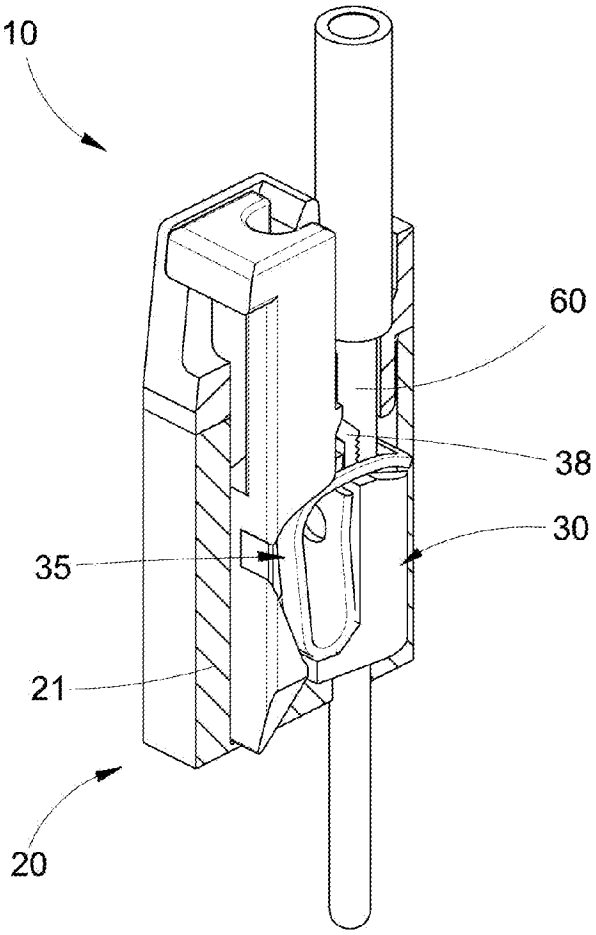
FIG. 7*b* is an axonometric view of the section of FIG. 7*a;*
Figure 7A:
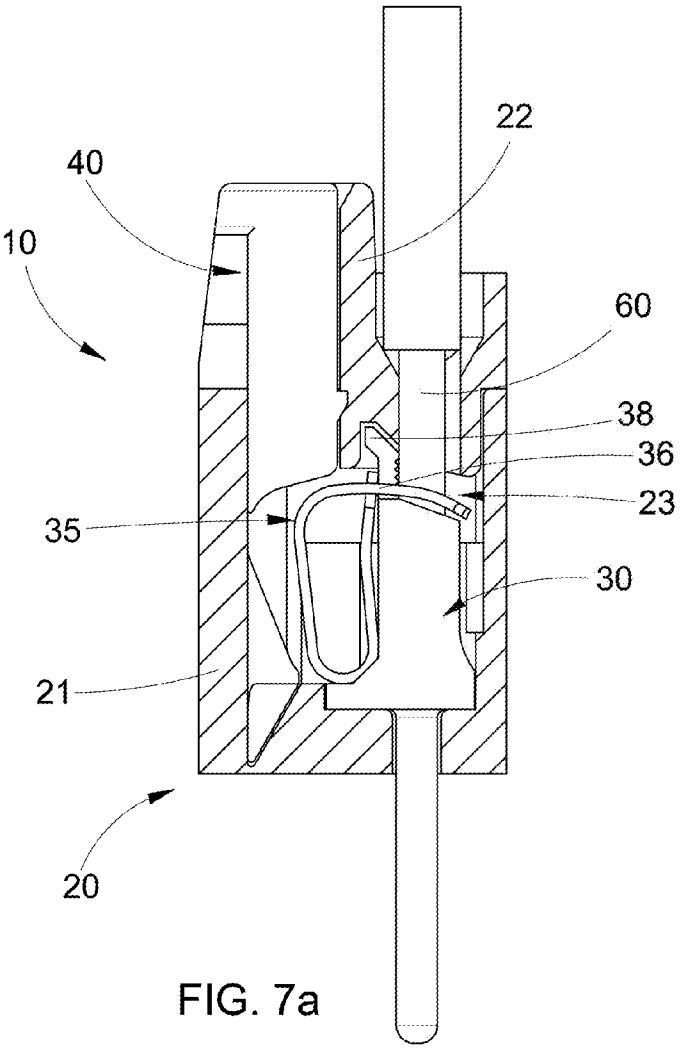
FIG. 7*a* is a cross-sectional view showing the electrical connecting device in the closed clamp position with wire and actuator pin inserted in their own seats.

FIG. 7 shows the electrical connecting device in a closed clamp condition, with the actuator pin 40 retractably inserted in its seat 24, i.e. without protruding from said seat, and the conductor 60 clamped in the spring clamp.

Figure 8B:
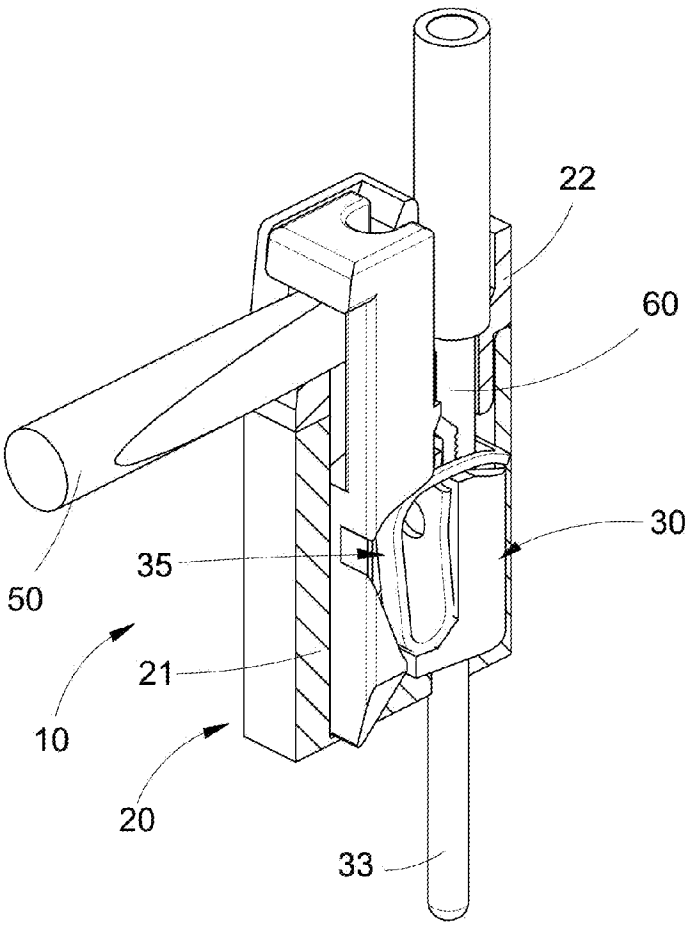
FIG. 8*b* is an axonometric view of the section of FIG. 8*a;*
Figure 8A:
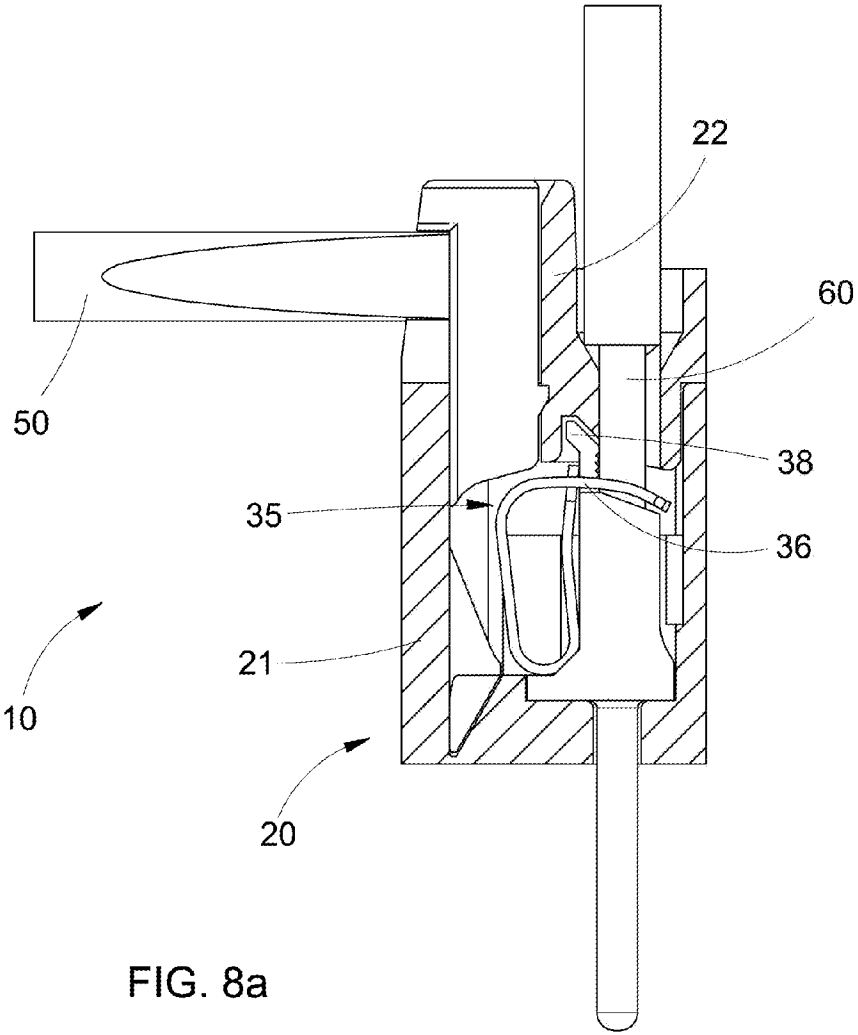
FIG. 8*a* is a cross-sectional view showing the electrical connecting device in the closed clamp position as in FIGS. 7*a, b* with the tip of a screwdriver inserted in a lateral slot of the actuator pin.

FIG. 8 is a view like that of FIG. 7, and it shows the tip of a screwdriver 50 with flat tip for slotted end screws inserted into the side slot 43 of the actuator pin 40.

Figure 9A:
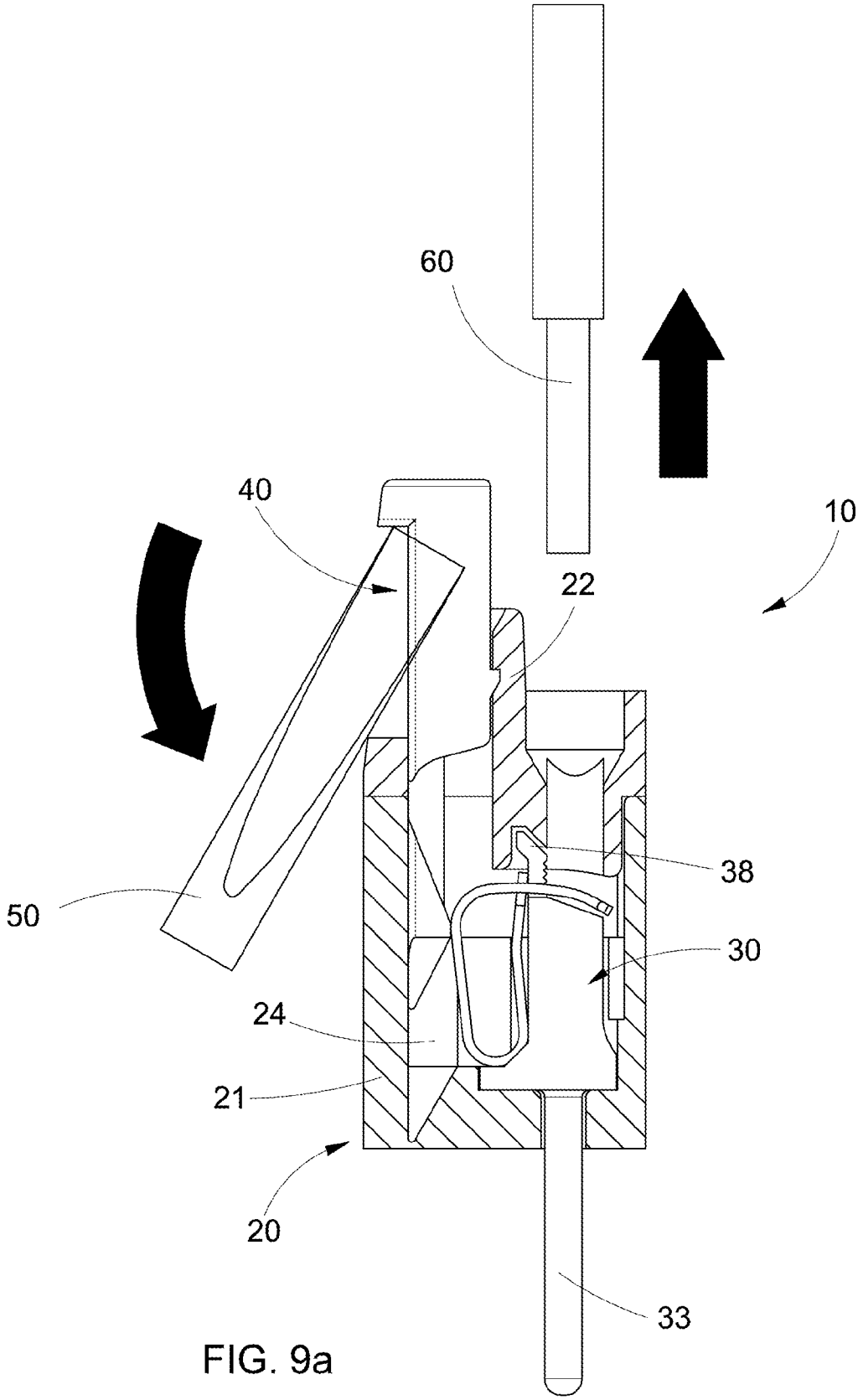
FIG. 9*a* is a cross-sectional view showing the electrical connecting device in the open clamp position with the actuator pin lifted by the tip of the screw driver and the conductor extracted.
Figure 9B:
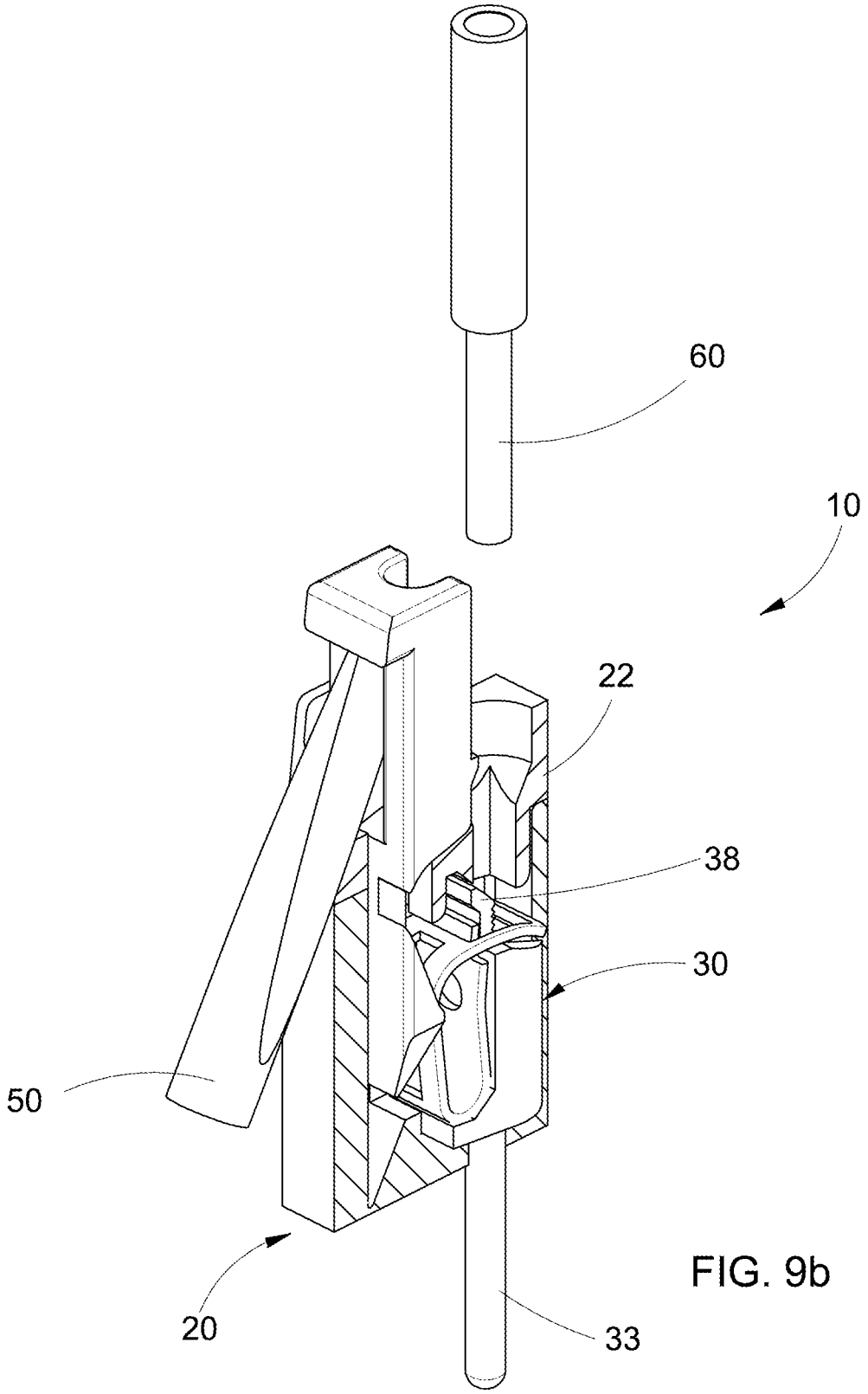
FIG. 9*b* is an axonometric view of the section of FIG. 9*a;*

By leveraging on the suitably grooved upper edge of the cover 22 of the body 20 a downward rotation of the screwdriver 50 is carried out causing the lifting of the actuator pin 40, whose protruding part 41 of the cam profile operates the compression of the spring 32 with the corresponding opening of the connection and the release of the conductor 60 that can be extracted, as shown in FIG. 9.

Figure 10:
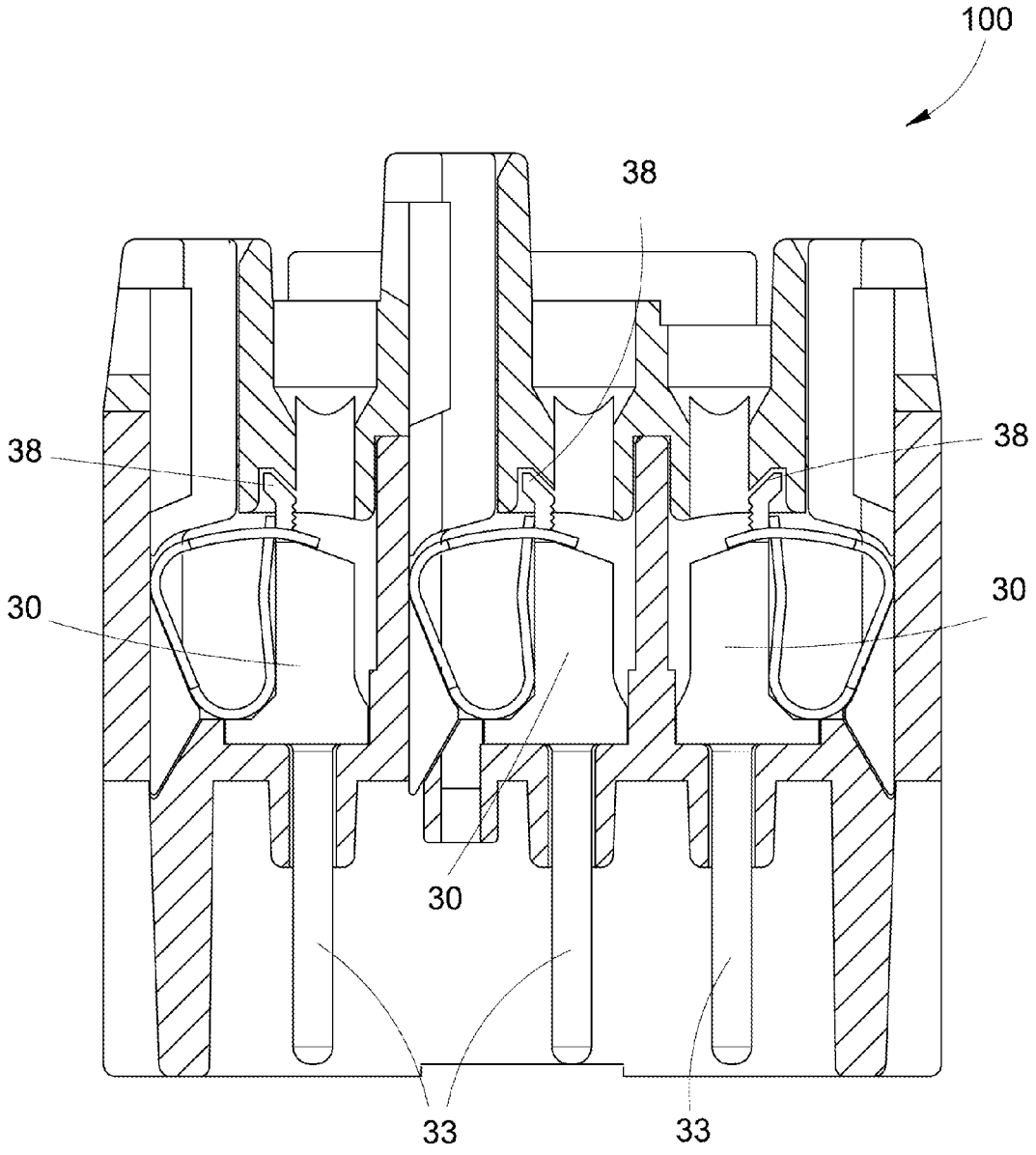
FIG. 10 is a cross-sectional view like that of FIG. 4*a*, of an exemplification of multi-pole plug connector provided with connection elements and actuator pins as shown in the preceding figures.

FIG. 10 is a transverse cross-section showing an example of a multi-pole plug connector 100 with three rows of contacts with actuator pins 40 retractably inserted, i.e. without protruding from said seat, into the respective seats of the insulating body of the plug connector, closed spring clamps (empty, without wires), this condition being that of maximum extension of the rear leg portion 35 of the ring-shaped springs 32. The transverse dimension (bulk) of the pins actuators 40 is zeroed, thanks to the taper 45 of the actuator pin and the corresponding window 39 provided in the rear ascending leg portion 35 of the spring, so that said actuator pins, transversely sectioned from the plane passing through the point of maximum extension of the springs, show a zero thickness. In this way, in the rest position (empty closed clamps) the completely extended springs are introjected in the corresponding cavities formed in the actuator pins minimizing the transverse dimension (bulk) of the assembly and allowing the provision of such spring connection elements with actuator in high density connecting devices or to equip with actuators the spring connection elements of existing devices without requiring increase of transverse dimensions.

In particular, in the example shown in FIG. 10, by employing spring contacts and actuator pins of the prior art, particularly as described in DE 102007009082, it would not have been possible to obtain three rows of electrical contacts in a plug connector body with the same transverse dimension.

From what is described the advantages of the invention appear evident, the invention being however not limited to the particular embodiment previously described and illustrated in the appended drawings, as it can be subject to numerous modifications of detail within the reach of the skilled in the art, without departing from the scope of the invention itself as defined by the appended claims.

The invention claimed is:

1. An electrical connecting device comprising:

an electrical insulating body with at least one pair of longitudinal parallel seats adapted to house, respectively, a connecting element with a terminal having a spring fixed thereto, and an actuator pin having a cam profile oriented towards said spring of the terminal to cause the opening and closure of the terminal by sliding into the corresponding seat, said spring being a ring-shaped spring having a curved elbow-shaped lower portion which acts as a real spring, a back portion, which is rear with respect to said terminal, and is continued with said curved elbow-shaped lower portion, said back portion being in a form of a leg ascending from said curved lower portion, said back portion being engageable with a projecting portion of said cam profile of the actuator pin, and an upper portion with a slot or aperture adapted to receive at least one electric conductor, wherein said cam profile of the actuator pin oriented towards said spring has at least one indentation and a remaining ribbed portion, and wherein said back ascending portion in a form of a leg of the spring has a corresponding groove which houses said at least one ribbed portion of the actuator pin in the maximum extension status of the spring, when the terminal is closed and empty without a conductor.

2. The electrical connecting device according to claim 1, wherein both the sides of the actuator pin have tapers delimited by an intermediate ribbed portion and wherein said groove provided on said back ascending portion in a form of a leg of the spring is a window able to house said intermediate ribbed portion of the actuator pin.

3. The electrical connecting device according to claim 2, wherein an intermediate ribbed portion is centrally provided to the actuator pin.

4. The electrical connecting device according to claim 1, wherein said actuator pin has a width not exceeding that of said connecting element with a spring terminal.

5. The electrical connecting device according to claim 1, wherein said actuator pin has a side seat for insertion of a tool tip.

6. The electrical connecting device according to claim 1, wherein said actuator pin has a longitudinal aperture oriented along the direction of said spring, configured to allow the insertion of a tester device probe for electrical measurements.

7. The electrical connecting device according to claim 1, wherein said electrical insulating body comprises a base and a cover.

8. The electrical connecting device according to claim 1, wherein said at least one conductor is a flexible or rigid one.

9. A multipole electrical plug connector incorporating a plurality of electric connecting elements having a spring terminal and actuator pins inserted in a rollaway fashion inside respective housing seats of the insulating body of the plug connector having the features according to claim 1.

* * * * *